US006086414A

United States Patent [19]

Tipton et al.

[11] Patent Number: 6,086,414

[45] Date of Patent: Jul. 11, 2000

[54] MULTIMEDIA OUTLET ARRANGEMENT

[75] Inventors: Regina L. Tipton, Nebo; Priscilla L. Seagle, Marion, both of N.C.

[73] Assignee: Hubbell Incorporated, Orange, Conn.

[21] Appl. No.: 08/953,450

[22] Filed: Oct. 17, 1997

[51] Int. Cl.[7] ..... H01R 13/60

[52] U.S. Cl. ..... 439/540.1; 439/640

[58] Field of Search ..... 439/527, 540.1, 439/638.4, 654

[56] References Cited

U.S. PATENT DOCUMENTS

D. 378,674 4/1997 Volansky et al. .
4,778,399 10/1988 Schenk .
5,033,804 7/1991 Faris .
5,309,564 5/1994 Bradley et al. .
5,477,546 12/1995 Shibata et al. .
5,515,511 5/1996 Nguyen et al. .
5,567,180 10/1996 Seo ..... 439/638
5,598,998 2/1997 Lynn .
5,807,139 9/1998 Volansky et al. ..... 439/638

*Primary Examiner*—Lincoln Donovan
*Attorney, Agent, or Firm*—Leopold Presser; Jerry M. Presson; Alfred N. Goodman

[57] ABSTRACT

A multimedia outlet housing or module possessing a capacity for the connection and containment of a variety of electrical and electronic media. The modular multimedia outlet housing includes selectively installable connector brackets adapted to contain a plurality of fiber/UTP connections, and wherein the housing incorporates fiber storage facilities and plastic surface raceway compatibility for a multiplicity of the most diverse applications.

18 Claims, 6 Drawing Sheets

MULTIMEDIA OUTLET ARRANGEMENT

BACKGROUND OF THE INVENTION

1. Field of the Invention

The present invention relates to a multimedia outlet arrangement and, more particularly, relates to a novel multimedia outlet housing or module possessing a capacity for the connection and containment of a variety of electrical and electronic media. More particularly, the invention is also directed to the provision of a modular multimedia outlet housing adapted to contain a plurality of fiber/UTP connections, and which includes fiber storage facilities and plastic surface raceway compatibility for a multiplicity of the most diverse applications.

In more recent years, electrical systems and devices which are employed in business and industry and also for domestic home usage have generated a requirement for an increased provision of access points or connections for the operation of widely diverse types of electrical equipment. For instance, such equipment may require various kinds of power outlets to facilitate connections with lighting, heating, air conditioning, kitchen appliances and other components. Furthermore, connections may also be required for HPW jacks, F-type connectors, BNC's, RCA's and numerous other types of connector choices, all of which necessitate their own connecting access points.

The foregoing has caused the need for providing a single modular unit or housing which is adapted to contain the various connecting points for the most diverse types of electrical appliances and equipment so as to enable the elimination of dispersed, cumbersome and frequently unsightly exposed wiring and receptacle locations, and allow for the provision of essentially a single multimedia outlet housing or module which combines practically all of these connections for numerous diverse commercial and household services.

A particularly advantageous aspect in providing a multimedia outlet module would be to provide a single housing or receptacle for the connectors of numerous electrical service lines or cables, different types of ribbon wires, telephone service, radio wave signal reception and coaxial cable amongst numerous other types of electrical wiring and fiber systems.

2. Discussion of the Prior Art

Currently, various types of multimedia outlet systems and modular housings are known in the technology, each essentially being designed to enable the connection, within a single housing or module, of pluralities of potentially diverse types of electrical appliance and power services.

Schenk U.S. Pat. No. 4,778,399 discloses a multi-service electrical outlet module which is adapted to be wall-mounted and which includes a box structure having recessed wall portions, each of which is adapted to provide connections or groups of connections for various types of electrical or power services. The recess in the box structure in which the plates or wall surfaces are arranged is adapted to be closed by means of suitable cover plate elements which may be attached through clamping elements or the like. Although this multi-service electrical outlet module enables the containment of a plurality of diverse electrical outlets and service connections, the interchanging or replacement of one type of electrical connection with another is rendered extremely difficult without having to substantially disassemble the entire module. Moreover, there is no provision for preventing the crimping of wires and cables which, at times, may lead to the breakage of fibers and resultant failure of one or more of the electrical services.

Volansky et al. U.S. Design Pat. No. 378,674 discloses a surface mounted multimedia outlet housing wherein a plurality of connecting locations are provided for different types of electrical systems or services in a comparable array of recesses formed in the housing.

SUMMARY OF THE INVENTION

Accordingly, in order to provide an advanced or improved multimedia outlet module or arrangement which incorporates numerous advantages over the current state of the technology, the present invention is directed to the concept of a unique modular housing wall structure for the mounting of a plurality of interchangeable connections which are compatible for fiber/copper service, and wherein the module incorporates an extensive connecting capacity for a variety of electrical or service media. Furthermore, incorporated into the housing interior of the module is a novel fiber storage facility and plastic surface raceway with a compatibility to support a large variety of multimedia applications, wherein a fiber storage drum is incorporated into the housing to protect bend radii of stored fibers, and in which a wire tie feature enables a user to anchor fibers without the danger of over-cinching.

The connectors for the various electrical and power services are separate and discrete bracket elements each being replaceably insertable into the modular housing of the multimedia outlet arrangement. Each of the connector bracket elements are customized to represent a specific type of connection, such as for HPW jacks, F-type connectors, BNC's, RCA's, and a variety of other kinds of connector choices as needed. Moreover, it is not absolutely necessary that the connector brackets be each utilized, such that when it is intended to only employ a limited number of connections for the multimedia outlet housing; in effect, less than the capacity of the housing, various of the connector brackets may be blanks which, when necessary, can be replaced by connector brackets each possessing the specific connection for a particular type of electrical service. The housing structure itself comprises essentially two major components, a bottom housing portion which is adapted to be surface mounted or supported on a substrate, and an upper housing cover portion which is adapted to be latched to the bottom housing portion during use, and which may be readily detached therefrom in order to provide access to the interior of the housing, and for replacement or exchange individual of the connector brackets in accordance with need.

Formed in lower housing portion are raceways for fibers, wires or the like, which enable a user to route fibers or wires leading from the various connector brackets while maintaining an acceptable fiber or wire bend radius and wherein the fibers may be slipped through suitable flexible support structure. Furthermore, wire-tie features incorporated in the housing may enable a user to anchor the fibers or wires without the danger of overcinching which can lead to possible breakage of the fibers or wires.

The foregoing versatility whereby the entire modular multimedia outlet housing is of a relatively simple molded plastic construction which is compatible with fiber/copper components, and an inherent compatibility with UTP, STP, coaxial and fibers, including fiber storage drum and raceway structure adapted to protect the bend radii of stored fibers and wires arranged or coiled within the housing, enables the bottom positioning of the connector brackets and protects the connections upon the superposition of the cover portion of the housing. Moreover, the invention provides for a low-profile and aesthetically attractive housing which is readily adapted to be surface mounted. Additionally, the cover portion of the housing may be equipped with a hidden label field beneath an openable flap-like door enabling access to information imprinted on the label field respecting individual of the connector bracket units and their respective connections.

Accordingly, it is an object of the present invention to provide a novel modular multimedia outlet arrangement enabling the connections within a single housing structure of the most diverse types of electrical services.

Another object of the present invention is to provide a multimedia outlet housing module of the type described incorporating a plurality of detachable and replaceably interchangeable connector brackets each providing a connector for the most diverse type of electrical service pursuant to the needs of a consumer.

Another object of the invention resides in the provision of a multimedia outlet arrangement including a modular housing providing for a fiber storage drum to protect the bend radii of coiled stored fibers.

BRIEF DESCRIPTION OF THE DRAWINGS

Reference may now be had to the following detailed description of a preferred embodiment of the invention, taken in conjunction with the accompanying drawings; in which.

BRIEF DESCRIPTION OF PREFERRED EMBODIMENTS

Figure 1:
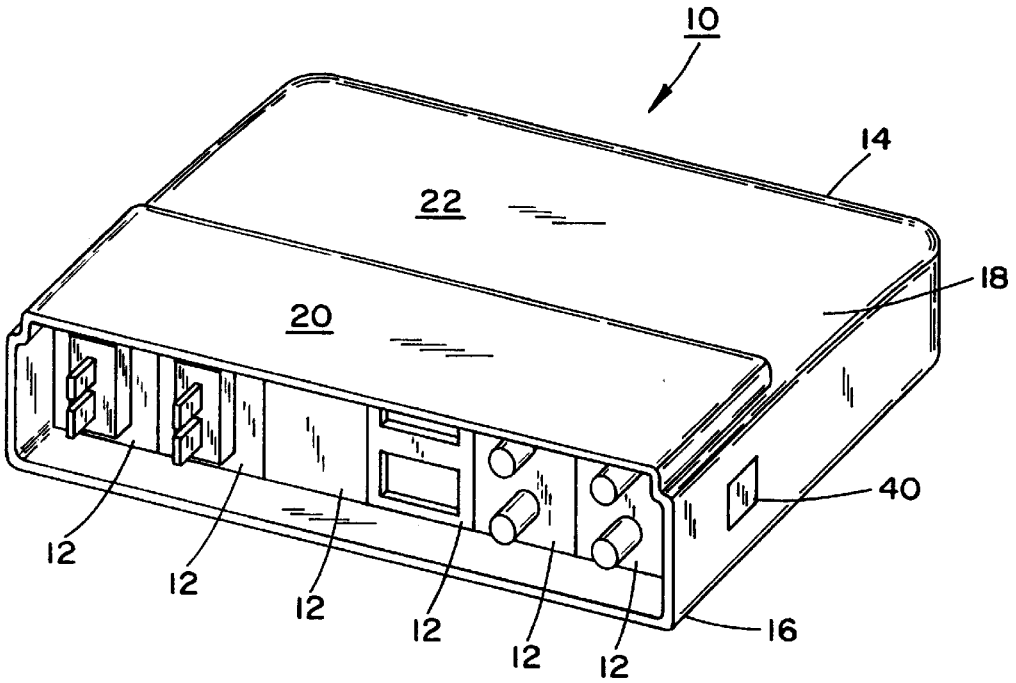
FIG. 1 illustrates a front and side perspective view of the modular multimedia outlet housing pursuant to the invention.

Referring now more specifically to the drawings, as shown in FIG. 1 in a generally perspective view, a multimedia outlet housing 10 incorporates a plurality of connector brackets 12 which are adapted to provide connections to a diverse array of electrical media components.

As illustrated, having particular reference to FIGS. 2 through 10 of the drawings, the multimedia outlet housing 10 consists of a modular structure preferably constituted of a rigid molded plastic material, which is fiber/copper compatible in nature. The housing 10 includes an upper housing portion 14 or cover structure of essentially rectangular configuration which is superimposable on a base or bottom housing portion 16 having upstanding wall structures about the rim thereof, as elucidated hereinbelow.

The upper housing portion or cover structure 14, as shown in FIGS. 2 through 5 of the drawings, includes a stepped upper wall surface 18 wherein an upper forward end section 20 is elevated relative to a rearwardly located section 22, the latter of which is angled slightly downwardly towards the rear edge 34 thereof. The depending side walls 26, 28 are slightly outwardly flared towards the lower ends thereof at the rear and the sides of the cover portion 14, and with the front end 30 being essentially open, as shown by means of the sectional view in FIG. 4 of the drawings.

Figure 2:
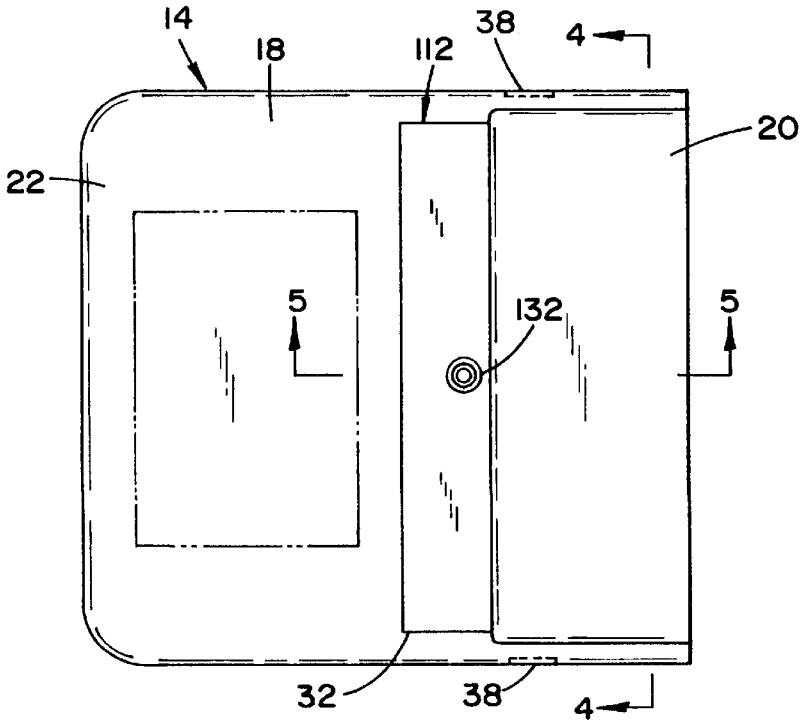
FIG. 2 illustrates a top plan view of the over portion of the modular housing.
Figure 3:
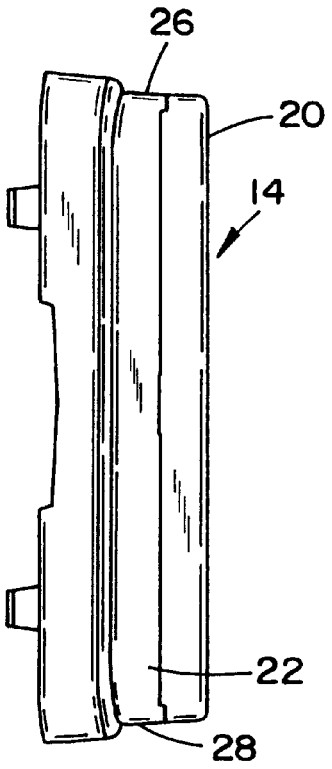
FIG. 3 illustrates a rear end view of the cover portion of the housing of FIG. 2.
Figure 4:
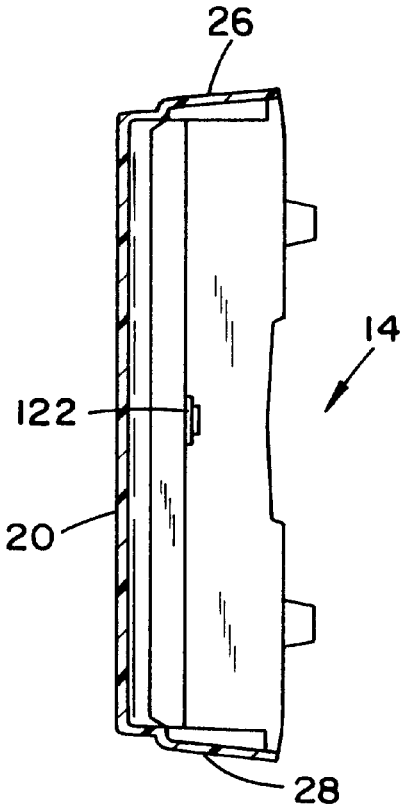
FIG. 4 illustrates a sectional view taken along line 4—4 in FIG. 2.
Figure 5:
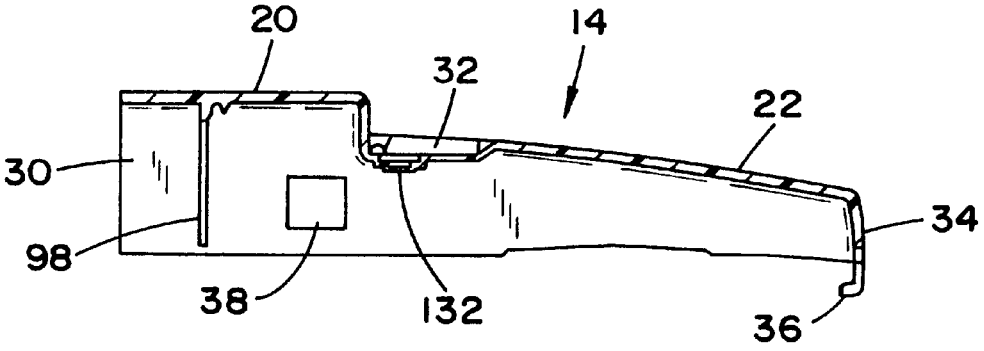
FIG. 5 illustrates a sectional view taken along line 5—5 in FIG. 2.
Figure 6:
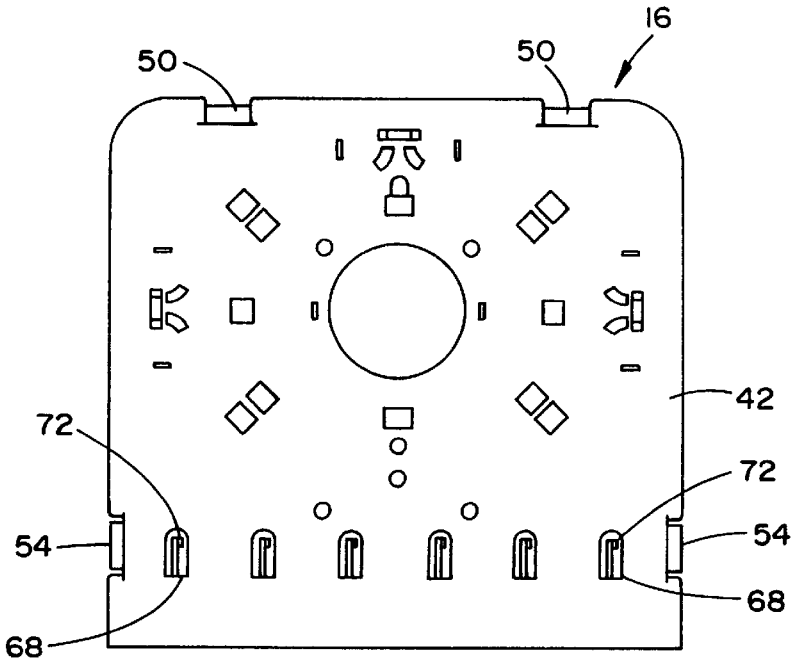
FIG. 6 illustrates a bottom view of the modular connector housing.

The upper surface section 22 of the housing cover portion 14 may be provided a rectangular recessed surface portion 32 proximate the rear edge of surface section 20, as shown in FIG. 2 and the sectional view of FIG. 5.

The rear wall 34 of the cover portion 14 may have a pair of depending spaced elements each including inwardly extending lip structure 36 forming a clamping arrangement for latching engagement with the base or bottom portion 16 of the housing 10, as described hereinbelow. Similarly, the side walls 26, 28 are each provided with a generally square cut-out 38 so as to facilitate the latching engagement therein of a resiliently deflectable latch arrangement 40 on the bottom housing portion 16 when the housing portions 14 and 16 are assembled with each other.

As may be ascertained from FIGS. 2 through 5, the upper housing portion 14 is essentially of a single-piece or unitary molded construction, such as from a rigid plastic material which is fiber and copper compatible.

The lower or bottom portion 16 of the housing 10, as illustrated more specifically in FIGS. 6 through 10 of the drawings, includes a generally planar bottom surface 42 having a central opening and other apertures arranged thereabout for the passage therethrough of fibers and/or wires, and for mounting on a suitable surface. The bottom surface 42 includes upstanding low or short side-walls 44, 46, and wherein a rear wall 48 incorporates spaced recessed portions 50 each having an undercut configuration adapted to be latching engaged by the inwardly depending lip structure 36 of the cover portion 14 when the latter is assembled on the bottom housing portion 16. The perimetrical dimensions of the side and rear walls 26, 28, 34 of the cover portion 14 of the housing are slightly larger than the external perimetrical dimensions of the rear and side walls 44, 46, 48 of the bottom housing portion 16 so as to enable the cover portion 14 to be superimposed thereover, with the front edge 30 thereof extending somewhat forwardly of the front end of the bottom portion 16.

Proximate to or slightly set back from the front end of the bottom housing portion 16, each of the side walls 44, 46 includes a flexibly resilient 25 upstanding wall section 52 having outwardly protruding pads 54 molded in the outer surfaces, which when the housing cover portion 14 is superimposed on the bottom housing portion 16 will be resiliently biased outwardly so as to cause the pads 54 to engage into the respective therewith aligned cutouts 38 in the side walls 26, 28 of the housing cover portion 14, thereby forming the latch arrangement 40 between the cover portion 14 and the bottom portion 16 of the housing 10.

The front end of the bottom housing portion 16 includes a short upstanding ledge or wall 60 which is lower in height than the sidewalls 44 and 46. Molded into the upper surface of the bottom structure, and spaced at predetermined intervals across the width of the bottom housing portion 16 are a plurality of plate-like or T-shaped ribs 64 which define an essentially rectangular surface configuration 66 therebetween which is formed on the upper surface of the bottom plate or surface 42. In each of the surface portions 66 there is provided a slot or cutout 68 having a resiliently flexible tongue member 70 extending therein, the free end of which has an upstanding hook-like finger portion 72. Proximate the end of each of the T-shaped ribs which connects to the front ledge 60, the ribs 64 extend upwardly so as to provide an upstanding wall structure 74, including a reinforcing triangular stiffening bracket 76 at the lower end. The wall structure 74, in transverse cross-section, defines essentially an I-beam shape which has vertically extending recesses or grooves 78 on both sides, as may be ascertained by viewing FIG. 7 of the drawings.

Adapted to be positioned in each of the surface areas 66 intermediate each of the T-shaped ribs 64 and the upstanding I-shaped wall structure 74 having the groove-like recesses 78 on opposite sides thereof, is respectively one of the bracket member 12, which in side view is in the shape of an L-shaped wall structure, preferably of a molded plastic material similar to that of housing 10.

Positioned in the modular multi-media outlet housing 10 are a plurality of the L-shaped media connector brackets 12, of which a blank bracket 12, in essence, having no media connections thereon, is illustrated in FIGS. 11 through 14 of the drawings, and as described hereinbelow Each generally L-shaped connector bracket 12 is configured to possess a vertical plate 80 having a front surface 82 adapted to form a portion of an upstanding front wall structure for the modular housing 10 in the assembled condition of cover and bottom housing portions 14 and 16. The L-shaped connector bracket 12 has a width essentially in conformance with the width of the surface 66 intermediate adjacently spaced of the T-shaped ribs 64, so that the lower portions 84 of the side edges 86 of the vertical plate 80 will slidingly engage into the facing vertical grooves 78 provided in the upstanding walls 74 between the adjacently spaced ribs 64. A bottom plate portion 88 of the bracket 12 extends at a right angle from the bottom edge of vertical plate 80 so as to form the L-shaped bracket configuration of unitary molded construction. The bottom plate portion 88 has at its opposite free end 90 centrally formed with a forwardly extending slotted cutout 92 which is adapted to be latchingly engaged by the flexibly resilient upstanding hook-like latching finger 72 in the bottom surface portion 66 of the housing bottom seated thereon such that, when the vertical wall or plate of the connector bracket 12 is fully slid downwardly so as to have the bottom plate portion 88 resting on the upper surface 66 of the bottom housing portion 16 of the housing between the raised T-shaped ribs 64 which are spaced apart and sized to conform with the perimeter of the bottom plate portion 88 of the L-shaped bracket 12. The finger-shaped hooked latch 72 then extends through the slotted cutout 92 the bottom plate portion of the bracket, and snaps into place over a slot side wall so as to clampingly lock the connector bracket 12 in position in the front part of the housing bottom portion 16. In essence, the front upstanding wall or plate portion of the connector bracket 12 has the side edge portions 84 thereof engaged into the vertical grooves 78 formed in the upstanding wall portions 74, and concurrently the resiliently deformable latch 72 in the base of the multimedia housing at the end of the resilient tongue structure engages through the slotted cutout in the bottom plate portion of the connector bracket 12 thereby locking the entire structure in place.

As illustrated, in the present housing, by way of example, six of the L-shaped connector brackets 12 may be detachably and interchangeably fastened in position in the housing in an aligned array adjacently or contiguously with each other, each connector bracket 12 being specifically adapted to form a particular electrical media connection, as set forth in detail hereinbelow.

Each of the connector brackets 12 also includes a pair of integrally molded spaced ribs 94 connecting the lower portion of the rear surface of the vertical plate portion 80 so as to extend into the upper surface of the essentially horizontal bottom plate portion 88 of the connector bracket 12 so as to stiffen the bracket and prevent it from being bent out of shape during installation and use. As previously indicated, each of the connector brackets 12 may be molded from a plastic material which is similar to or identical with that of the multimedia outlet housing cover and bottom portions 14 and 16.

As illustrated in FIGS. 15 through 22 different types of media outlet connectors 12 may be provided for each of the connector brackets 12.

Figure 15:
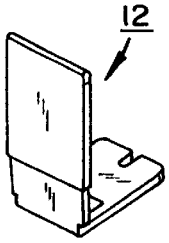

Thus, as is shown in FIG. 15, the bracket 12 is essentially that illustrated in FIGS. 11 through 14, whereby the blank vertical bracket plate surface 88 represents that this particular bracket is mounted in a location in the housing 10 which is presently not utilized for a media connection, but is arranged primarily for the purpose of providing a front wall segment closing off an opening leading to the interior of the multimedia outlet housing 10.

Different types of electrical or media connections may be provided by respective of the brackets 12 as shown in FIGS. 16 through 22 of the drawings.

Figure 16:
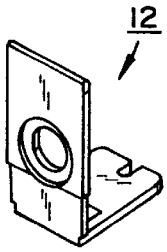
FIG. 16 illustrates a connector bracket similar to that of FIG. 15, configured for a BNC connection.
Figure 17:
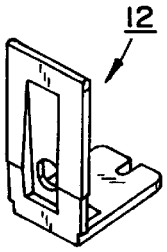
FIG. 17 illustrates a bracket similar to that of FIG. 15, configured for an F connection.
Figure 18:
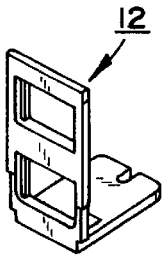
FIG. 18 illustrates a bracket similar to FIG. 15, configured for the connection of two high-density jacks.
Figure 19:
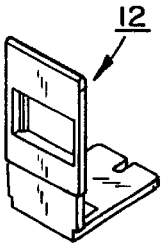
FIG. 19 illustrates a bracket similar to FIG. 15, configured for the connection of a HPW jack.

Thus, as shown in FIG. 16, the upstanding wall or plate portion of the connector bracket is apertured for a BNC-connection; in FIG. 17 the cutout in the upstanding wall or plate portion of the connector bracket is apertured for an F connection; in FIG. 18 the front wall or plate portion of the connector bracket is configured as an AMO bracket for two high density jacks; in FIG. 19 the front upstanding wall or plate portion of the connector bracket is configured as an AMO bracket for one HPW jack, or any HPW keystone jack.

Figure 20:
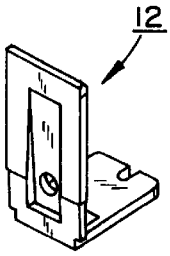
FIG. 20 illustrates a bracket similar to that of FIG. 15, configured for a solder-type RCA connector.
Figure 21:
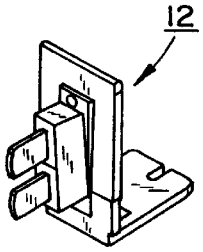
FIG. 21 illustrates a bracket similar to FIG. 15, shown with a fiber adapter, in this instance, a 1 SM/MM SC duplex adapter.
Figure 22:
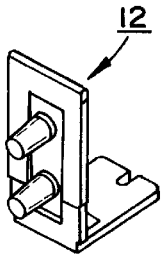
FIG. 22 illustrates a bracket similar to that of FIG. 15, shown with 2 SM/MM ST adapters.

FIG. 20 illustrates the upstanding wall or plate portion of the connector bracket with a cutout configured as a bracket for a solder type RCA connector; FIG. 21 illustrates the bracket as shown equipped with one SM/MM SC duplex adaptor; and FIG. 22 illustrates the bracket equipped with two SM/MM ST-adaptors.

As shown in FIG. 1 of the drawings, by way of example, the housing 10 is adapted to receive or mount six connector brackets 12 in side by side relationship, each equipped for respectively different types of connections, or representing blank wall segments. A narrow continuous rib structure 98 may be formed within the housing cover portion 14 so as to extend in front of the upper ends and side edges of the outermost brackets 12 when assembled in the housing 10 so as to assist in closing off the front of the assembled housing components.

Furthermore, the housing may be designed in different sizes to contain up to possibly 12 brackets for fiber/UTP connections, and will accept HPW jacks, F connectors, BNC's, RCA's and other connector choices, as desired for any variety of media.

As illustrated in the drawings, specifically as shown in FIGS. 7 through 10 and FIGS. 23, the housing bottom portion 16 includes fiber storage facilities.

Figure 7:
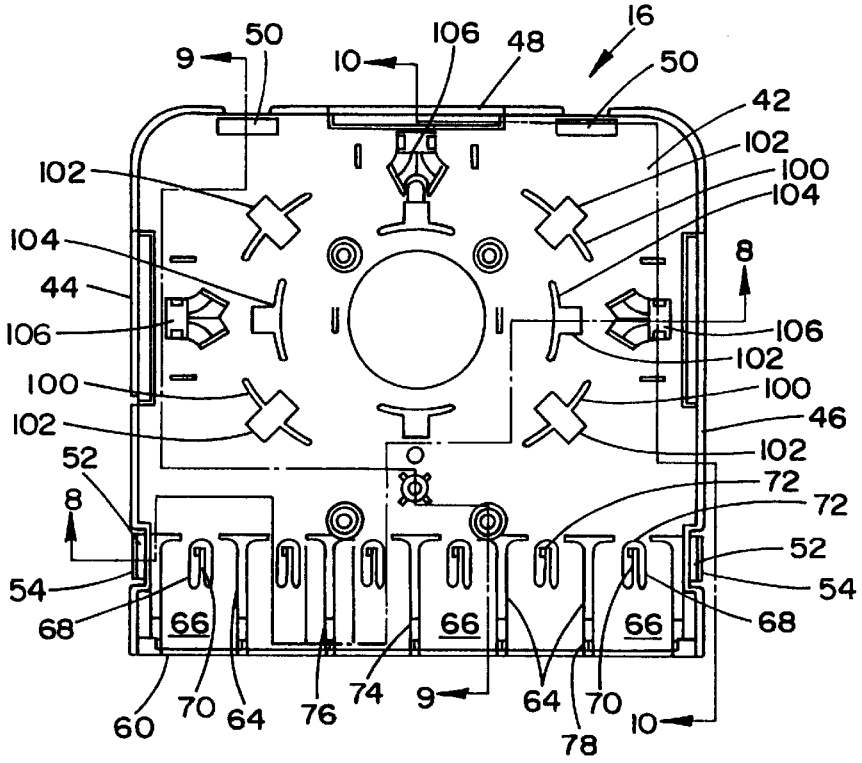
FIG. 7 illustrates a top plan view of the base portion of the modular connector housing.
Figure 8:
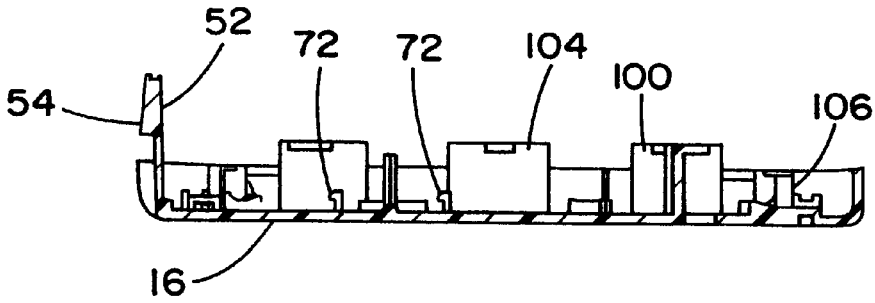
FIG. 8 illustrates a sectional view of the base portion of the housing taken along line 8—8 in FIG. 7.
Figure 9:
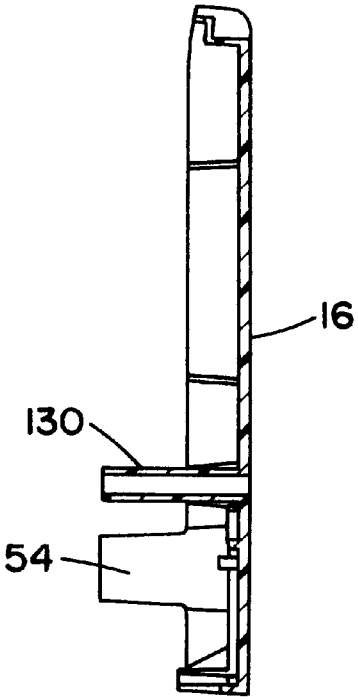
FIG. 9 illustrates a sectional view through the base portion of the housing taken along line 9—9 in FIG. 7.
Figure 10:
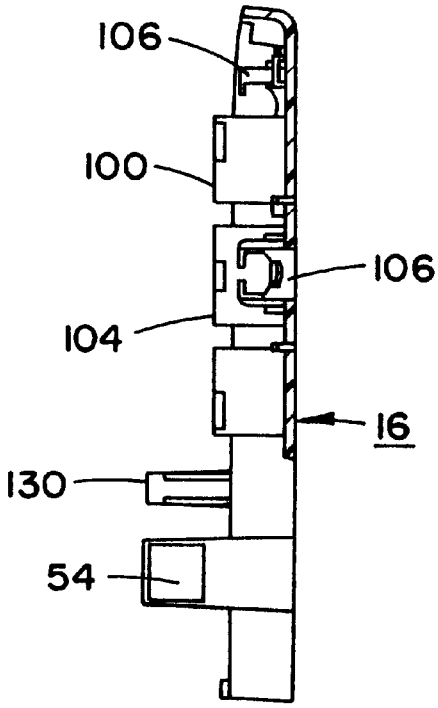
FIG. 10 illustrates a sectional view taken along line 10—10 in FIG. 7.
Figure 11:
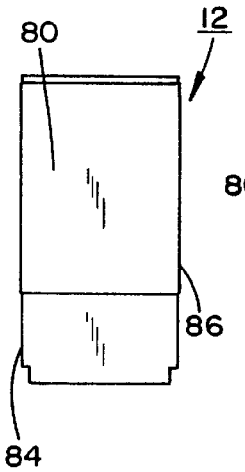
FIGS. 11 through 15 illustrate, respectively, front, side, rear, top, and perspective views of a typical connector bracket, shown without electrical connections adapted to be installed in the modular connector housing of FIG. 1, this embodiment of the connector bracket being a blank bracket.
Figure 12:
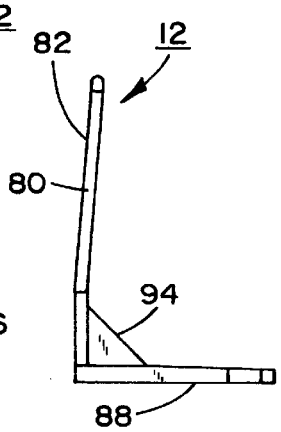
Figure 13:
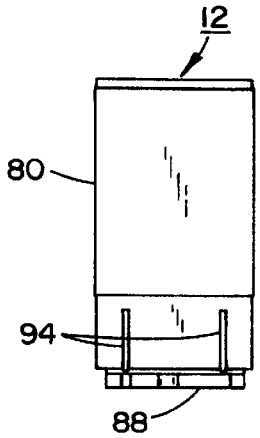
Figure 14:
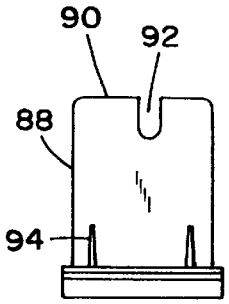
Figure 23:
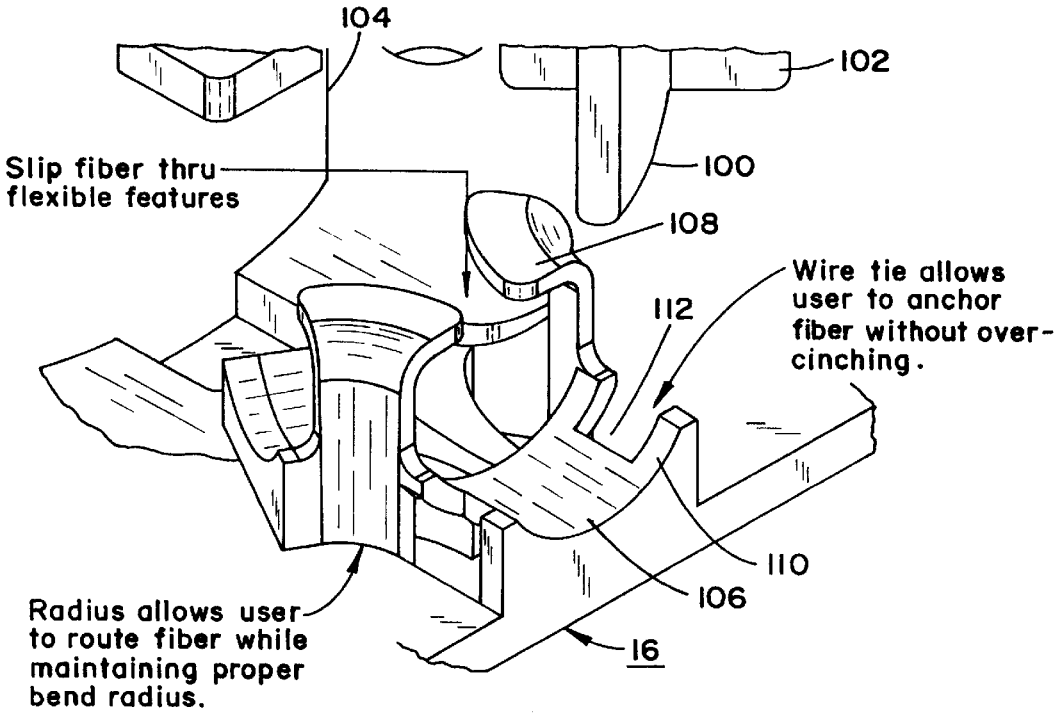
FIG. 23 illustrates diagrammatically on an enlarged scale, a portion of the raceway structure formed in the modular connector housing base portion.

Thus, viewing in particular FIG. 7 and 23 of the drawings, there are shown a plurality of upstanding curvilinear wall segments 100 defining annular outer raceways in a radially outer location, and having upper guide plates 102 extending in coplanar parallel spaced relationship with the upper surface of the bottom portion 16 of the housing 10, and an inner curvilinear raceway structure 104 interposed radially inwardly annularly offset between the outer raceways 100, so as to essentially constitute a fiber storage drum structure.

Further, measured in height, lower positioned structural elements 106 are located in at least three circumferentially spaced positions externally of the raceways, and have upper guide plate elements 108 at a spacing therebetween.

As illustrated, the raceways 100, 104 forming the fiber storage drum permit the winding of fibers or copper conduits or connectors (not shown) so as to prevent tangling thereof, whereas the small outer elements 106 enable the slipping through of fibers with the incorporation further wire tie features 110 through the provision of a recess 112 which enables a user to anchor the fiber adjacent the lower elements without over-cinching or crimping The radius of these lower elements 106 along the outside thereof enables the user to route the fibers into and along the raceways 100, 104 while maintaining appropriate protective bend radii for the fibers or copper conductors.

The foregoing structure of the raceway structures facilitates that a large number of fibers and copper conductors may be wound within the housing 10 without cinching or breakage thereof at appropriate radii so as to constitute a suitable drum-like fiber storage facility in a protective environment.

Figure 25:
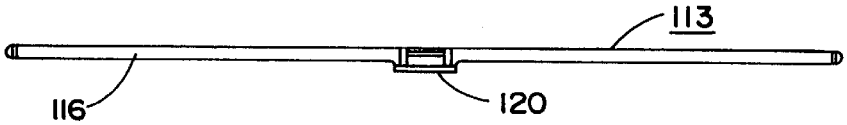
FIGS. 24, 25 and 26 illustrate, respectively, top plan, front and sectional views, the last being taken along line 26—26 in FIG. 24, of a pivotable door element which is mountable on the cover portion of the multimedia connector housing to provide access to hidden information concerning the various connector brackets and connections contained in the housing.
Figure 24:
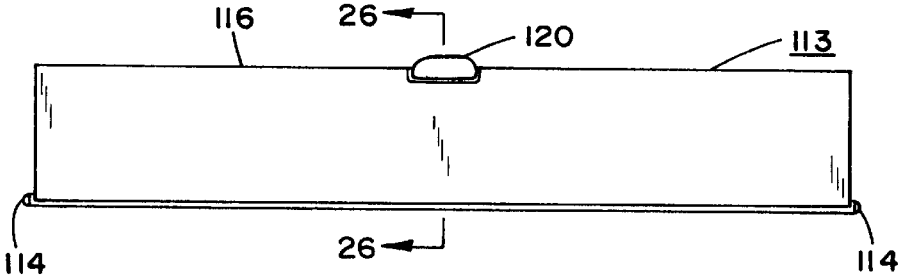
Figure 26:
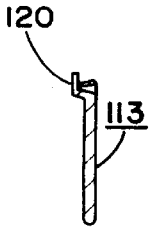

In order to identify the particular type of exchangeable connector bracket 12 employed in the housing, when the entire multimedia outlet housing 10 is assembled, the upper surface of the cover portion 14 of the housing containing the elongate rectangular recess 32 which extends across the upper surface, is adapted to have a plastic door or closure element of plate-like flap configuration 113, as shown in Figures 24 through 26, hingedly attached thereover. The plastic door or flap 113 is hinged by means of hinge pins 114 formed at opposite ends thereof into hinge holes 116 formed in the housing by a slight resilient flexural bending of the door. At the center of an opposite longitudinal edge 116 of the pivotably hinged door 113, a latch element 120 is adapted to engage into a slit 122 formed in the upper surface of the housing cover portion 14 so as to be able to latch the door shut during use. In order to gain access to the recessed portion beneath the hinged door 113, it is merely necessary to impart an upward pull to the latch element 120, releasing the latter to enable swinging the door open, thus exposing the interior of the elongate rectangular recessed portion 32 in the upper housing surface. Within this recess portion 32 there may be glued a strip of paper bearing information regarding the locations of the various connector brackets 12 and the types of electrical or media connection each respectively provides for a user.

Moreover, in order to prevent the housing cover portion 14 from being inadvertently detached from the bottom portion 16 subsequent to superposition and latching engagement between the latching elements at the rear wall and the cooperating latching elements in the side walls of the cover and bottom portions, the bottom portion 16 may be provided with an upstanding post 130 which has an internally screwthreaded free upper end, and wherein the recess portion 32 beneath the door 113 on the cover portion 14 may have a screw inserted through an aperture 132 formed therein so as to provide a fastening between the housing portions 14 and 16, although it is possible to have the interior of upper housing cover portion 14 simply rest on the post in order to prevent its undue deflection downwardly when pressure is applied to the housing cover portion 14.

From the foregoing, it becomes readily apparent that the invention is directed at a unique and novel multimedia outlet housing construction which facilitates the ready positioning and interchangeability of the various types of media connections a simple and expedient manner.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A multimedia outlet arrangement for a plurality of connectors for diverse electronic and electrical media; comprising:

(a) a modular housing including a housing bottom portion and a housing cover portion attached superimposed on said bottom portion;

(b) a plurality of brackets for the mounting of connectors being positionable in said modular housing intermediate said housing bottom and cover portions for selectively providing outlet connections for diverse electrical and electronic media;

(c) said housing bottom surface including upstanding arcuate radially inner and outer located raceways for winding fibers and conductors thereabout at predetermined bend radii;

(d) wire tie and fiber anchoring structures arranged radially and circumferentially spaced about said raceways, said raceways and wire tie and anchoring structures being integrally formed with said housing bottom portion, said housing bottom portion comprising a planar rectangular bottom surface; upstanding wall surfaces extending from the perimeters of said planar bottom surface, said connector mounting brackets being detachably fastened to said rectangular bottom surface, so as to extend in an array along one side of said bottom surface, each said connector mounting bracket having a generally L-shaped configuration including an upstanding wall portion and a horizontal wall portion extending from the bottom of said upstanding wall portion, said horizontal wall portion of each said connector mounting bracket including a central slot in an edge distant from the upstanding wall portion; and resiliently flexible latch means being formed in the bottom surface of said housing bottom portion, said latch means being latchingly engageable in said slot so as to lock said connector mounting bracket in position upon being slid down into contact with said bottom surface.

2. An arrangement as claimed in claim 1, wherein said housing cover portion has a generally rectangular configuration including planar upper wall surfaces and depending side walls and one end wall, said housing cover portion being superimposed on said housing bottom portions whereby said connector mounting brackets extend below said cover portion at an end region opposite said one end wall and essentially close off the interior of said modular housing.

3. An arrangement as claimed in claim 1, wherein said housing bottom portion includes upstanding wall structure along the edge for fastening said connector brackets, said wall structure comprises a plurality of spaced elements each having vertical grooves formed therein, one said connector mounting bracket being positioned intermediate respectively two of said spaced elements such that opposite side edges of said connector mounting bracket is slidingly received in said vertical grooves.

4. An arrangement as claimed in claim 1, wherein the upstanding wall portion of at least one said connector mounting bracket is configured as a blank wall surface.

5. An arrangement as claimed in claim 1, wherein the upstanding wall portion of at least one said connector mounting bracket is configured to contain a BNC-connection.

6. An arrangement as claimed in claim 1, wherein the upstanding wall portion of at least one said connector mounting bracket is configured to contain an F-connection.

7. An arrangement as claimed in claim 1, wherein the upstanding wall portion of at least one said connector mounting bracket is configured to contain two high-density jack connections.

8. An arrangement as claimed in claim 1, wherein the upstanding wall portion of at least one said connector mounting bracket is configured to contain a HPW jack connection.

9. An arrangement as claimed in claim 1, wherein the upstanding wall portion of at least one said connector mounting bracket is configured to contain a solder-type RCA connection.

10. An arrangement as claimed in claim 1, wherein the upstanding wall portion of at least one said connector mounting bracket is configured to contain one SM/MM SC duplex adapter.

11. An arrangement as claimed in claim 1, wherein the upstanding wall portion of at least one said connector mounting bracket is configured to contain two SM/MM ST adapters.

12. An arrangement as claimed in claim 1, wherein said housing cover portion and said housing bottom portion include cooperating wall structures for releasably latching said housing portions to each other upon superposition of said housing portions.

13. An arrangement as claimed in claim 12, wherein said cooperating wall structures include upwardly extending side wall segments of said housing bottom structure having protruding elements resiliently engageable into cutouts formed in the depending side walls of said housing cover structure.

14. An arrangement as claimed in claim 12, wherein said cooperating wall structures include latching wall sections formed in a rear edge of said housing portions.

15. An arrangement as claimed in claim 2, wherein the planar upper wall surfaces of said housing cover portion have a stepped configuration; and recess means being formed in a lower wall surface adjoining a higher wall surface of said stepped surface configuration.

16. An arrangement as claimed in claim 15, wherein indicia providing information relative to the types of connection and locations of respective of said connector mounting brackets is arranged in said recess.

17. An arrangement as claimed in claim 16, wherein a pivotable door flap is mounted above said recess so as to maintain said information hidden from view during use of said arrangement by being latched to said upper planar surface on the housing cover portion.

18. An arrangement as claimed in claim 1, wherein said modular housing and connector mounting brackets are formed from a molded plastic material which is fiber and copper compatible.

* * * * *